US010329732B2

(12) United States Patent
Abgrall et al.

(10) Patent No.: US 10,329,732 B2
(45) Date of Patent: Jun. 25, 2019

(54) BUCKET FOR A CONSTRUCTION VEHICLE USED FOR LOADING, MOVING, TRANSPORTING, POURING OR SPREADING BULK MATERIAL

(71) Applicant: ABGRALLL CONCEPTION, Daoulas (FR)

(72) Inventors: Roland Abgrall, Logonna Daoulas (FR); Pierrick Abgrall, Daoulas (FR); Philippe Abgrall, Dirinon (FR)

(73) Assignee: ABGRALLL CONCEPTION, Daoulas (FR)

( * ) Notice: Subject to any disclaimer, the term of this patent is extended or adjusted under 35 U.S.C. 154(b) by 15 days.

(21) Appl. No.: 15/735,189

(22) PCT Filed: Jun. 10, 2016

(86) PCT No.: PCT/FR2016/051396
§ 371 (c)(1),
(2) Date: Jun. 8, 2018

(87) PCT Pub. No.: WO2017/005999
PCT Pub. Date: Jan. 12, 2017

(65) Prior Publication Data

US 2018/0266070 A1 Sep. 20, 2018

(30) Foreign Application Priority Data

Jun. 11, 2015 (FR) ..... 15 55333

(51) Int. Cl.
*E02F 3/40* (2006.01)
*E02F 3/407* (2006.01)
(Continued)

(52) U.S. Cl.
CPC ..... *E02F 3/4075* (2013.01); *E02F 3/352* (2013.01); *E02F 3/3677* (2013.01); *E02F 3/432* (2013.01); *E02F 3/962* (2013.01)

(58) Field of Classification Search
CPC ..... E02F 3/4075; E02F 3/352; E02F 3/3677; E02F 3/432; E02F 3/962
See application file for complete search history.

(56) References Cited

U.S. PATENT DOCUMENTS 1,493,698 A * 5/1924 Pearson ..... E02F 3/4075 37/444
2,472,076 A 6/1949 Howe
(Continued)

FOREIGN PATENT DOCUMENTS

DE 10 2013 221285 A1 2/2014
FR 2779456 A1 12/1999
(Continued)

*Primary Examiner* — Jamie L McGowan
(74) *Attorney, Agent, or Firm* — Im IP Law; C. Andrew Im; Chai Im

(57) ABSTRACT

A bucket for an industrial vehicle configured to load, move, transport, tip and spread a bulk material. The bucket includes two lateral panels extending on each side of a loading panel having a loading edge and an unloading edge. The bucket includes a support panel, an opening panel, an adjuster and a fixing attachment. The adjuster includes a rotationally movable roller situated under the bucket and configured to turn in the direction of rotation of the wheels of the vehicle and to rest on the ground during spreading. The fixing attachment is configured to be fixed to the vehicle and is housed in a vertical translational movable space configured to leave travel for vertical translational movement. The fixing attachment is configured to rotationally move about an axis of rotation perpendicular to the support panel so as to turn the bucket relative to the ground.

10 Claims, 5 Drawing Sheets

(51) Int. Cl.

| | |
|---|---|
| ***E02F 3/352*** | (2006.01) |
| ***E02F 3/36*** | (2006.01) |
| ***E02F 3/43*** | (2006.01) |
| ***E02F 3/96*** | (2006.01) |

(56) References Cited

U.S. PATENT DOCUMENTS 2,851,171 A * 9/1958 Martin ..... E02F 3/283 177/139
3,481,056 A 12/1969 Meade et al.
3,869,054 A * 3/1975 Moreau ..... E02F 3/407 37/444
4,055,255 A 10/1977 Vasquez
4,512,090 A * 4/1985 Billings ..... E02F 3/7604 172/249
4,824,319 A * 4/1989 Arnold ..... E02F 3/3613 414/723
4,999,022 A * 3/1991 Veys ..... E02F 3/345 172/819
5,114,299 A * 5/1992 Roche ..... E02F 3/404 37/403
5,121,557 A * 6/1992 Moore ..... E02F 3/3677 37/406
5,416,990 A * 5/1995 Otwell ..... E02F 3/40 37/379
5,526,591 A * 6/1996 Otwell ..... E02F 3/40 37/379
5,562,398 A 10/1996 Knutson
5,940,996 A * 8/1999 Cummings ..... E02F 3/404 37/409
6,360,459 B1 * 3/2002 Brookhart ..... E02F 3/345 172/825
6,467,202 B1 * 10/2002 Brown, Jr. ..... E02F 3/4075 37/398
6,662,480 B1 12/2003 Stevens
7,351,028 B2 * 4/2008 Potter ..... E02F 3/3677 37/468
8,517,629 B2 * 8/2013 Gregerson ..... E01C 23/06 404/110
8,678,103 B2 * 3/2014 Miyuki ..... E02F 3/7631 172/813
9,277,691 B2 * 3/2016 Meyer ..... A01D 87/127

FOREIGN PATENT DOCUMENTS

| | | | |
|---|---|---|---|
| JP | H09 125446 | A | 5/1997 |
| JP | 2004 201512 | A | 7/2004 |
| JP | 2004 316101 | A | 11/2004 |
| UA | 20 023 | U | 1/2007 |
| WO | 93/00486 | A1 | 1/1993 |

* cited by examiner

BUCKET FOR A CONSTRUCTION VEHICLE USED FOR LOADING, MOVING, TRANSPORTING, POURING OR SPREADING BULK MATERIAL

RELATED APPLICATIONS

This application is a § 371 application from PCT/FR2016/051396 filed Jun. 10, 2016, which claims priority from French Patent Application No. 15 55333 filed Jun. 11, 2015, each of which is herein incorporated by reference in its entirety.

TECHNICAL FIELD OF THE INVENTION

The present invention relates to a bucket fitted to a vehicle intended to move, transport, tip a bulk material and spread it over a chosen thickness.

Spreading is defined as being spreading out a product or material over the ground, dispersing it.

PRIOR ART

The use of a spreading-out operation requires a special-purpose machine which is awkward to maneuver.

Another way of achieving spreading is to do it by hand using manual labor. In that case, the work still remains very difficult because the loads to be moved around are heavy and repetitive.

Document FR2779456 describes a grader blade fitted to a vehicle and intended for the handling of bulk materials. However, that device is not designed to adjust the thickness of the spreading.

Document U.S. Pat. No. 4,055,255 describes an industrial vehicle comprising a bucket. The bucket makes it possible to choose the quantity of bulk material to be tipped out, but the bucket disclosed is not in any way designed to regulate the thickness of the layer of material during the spreading phase.

OBJECT OF THE INVENTION

The present invention seeks to overcome these disadvantages.

To that end, according to a first aspect, the present invention relates to a bucket for an industrial vehicle intended to load, move, transport, tip and spread a bulk material, the bucket comprises two lateral panels extending on each side of a loading panel, said loading panel comprises a loading edge and an unloading edge, notable in that the bucket also comprises:

- a support panel for supporting an adjusting system designed to adjust the thickness of the layer of bulk material to be spread on the ground, said support panel being situated on the other side of the bucket from the loading panel,
- an opening panel comprising a gate comprising an opening edge, when the gate is in the closed position the opening edge is adjacent to the unloading edge of the loading panel, said closed position is designed to hold back the bulk material, when the gate is in the open position, the opening edge moves away from the unloading edge of the loading panel and an opening is created, said opening is intended to allow the bulk material to pour out,
- the adjusting system comprises a roller capable of rotational movement situated under the bucket and designed to turn in the direction of rotation of the wheels of the vehicle and to rest on the ground during spreading,
- a fixing attachment designed to be fixed to the vehicle, said attachment being housed in a space capable of vertical translational movement configured to leave travel for vertical translational movement and said fixing attachment is capable of rotational movement about an axis of rotation perpendicular to the support panel so as to turn the bucket relative to the ground.

Thanks to these measures, the bucket has several functions: loading, moving, transporting, tipping out a bulk material or spreading same over a chosen thickness.

Thus, the thickness of the bulk material tipped out during the spreading phase is kept fixed using a roller irrespective of the unevennesses of ground encountered.

The fixing attachment is a floating attachment and adapts to the terrain to ensure the same thickness of bulk material during spreading. The bucket is able to follow the contour of the route. The bucket perfectly follows the support and can be fitted to all types of loader (loading shovel, tractor shovel, telescopic loader, tractor loader, etc.).

The bucket makes it possible to:

- enormously relieve the workload on individuals (less handling: wheelbarrows and floats),
- save production time (speed of spreading),
- control the thickness of the spreading,
- provide a manual finish (no difference between hand and machine, no visible joins between passes) as with a finisher for creating a coated surface.

Other advantages:

- simple to use,
- little wear (no gearing).

In one embodiment, the vertical travel of the fixing attachment is of the order of 0.5 to 50 cm, preferably from 1 to 15 cm.

In one embodiment, said roller is capable of vertical translational movement relative to the ground so as to vary the height of the bucket relative to the ground. Thus, the spreading thickness can be chosen.

In one embodiment, the gate is capable of rectilinear translational movement supported on guideways on each side of the gate, said mobility is actuated by actuating cylinders.

In one embodiment, the length of the roller is at least equal to half the length of the bucket.

In one embodiment, the bucket comprises a plurality of gates capable of rectilinear translational movement.

Thus, the bucket can tip a certain quantity of bulk material out on just one side or the other. In addition, the act of opening over a certain length makes it possible to vary the width of the strip of bulk material to be spread. Another advantage is, for example, that of opening a gate over a wheelbarrow and of being able to tip bulk material out to fill the wheelbarrow.

In one embodiment, it comprises a surface that reduces the opening created by the opening panel in the open position.

In one embodiment, the surface is capable of translational movement by means of an adjusting element that adjusts the position of the surface relative to the opening created by the opening panel in the open position.

The invention also relates to a vehicle equipped with a bucket described hereinabove.

BRIEF DESCRIPTION OF THE FIGURES

Further advantages, objects and features of the present invention will become apparent from the following description given by way of entirely nonlimiting explanation with reference to the attached drawings in which.

DESCRIPTION OF THE EMBODIMENTS OF THE INVENTION

Figure 1:
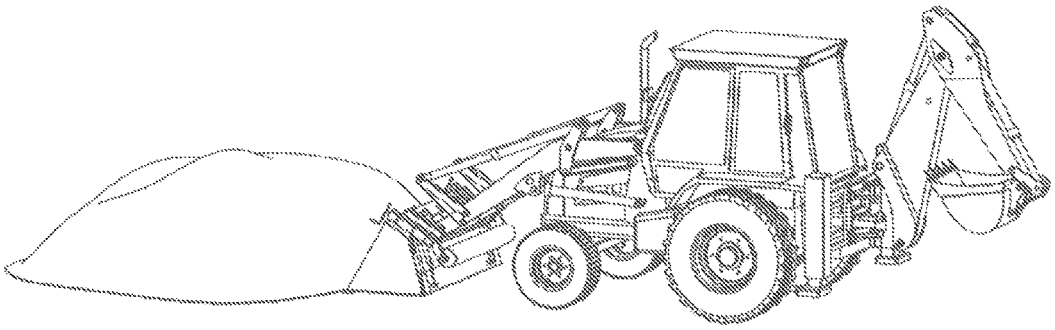
FIGS. 1 and 2 depict a diagram of the loading of bulk material into the bucket that forms the subject of the present invention.
Figure 2:
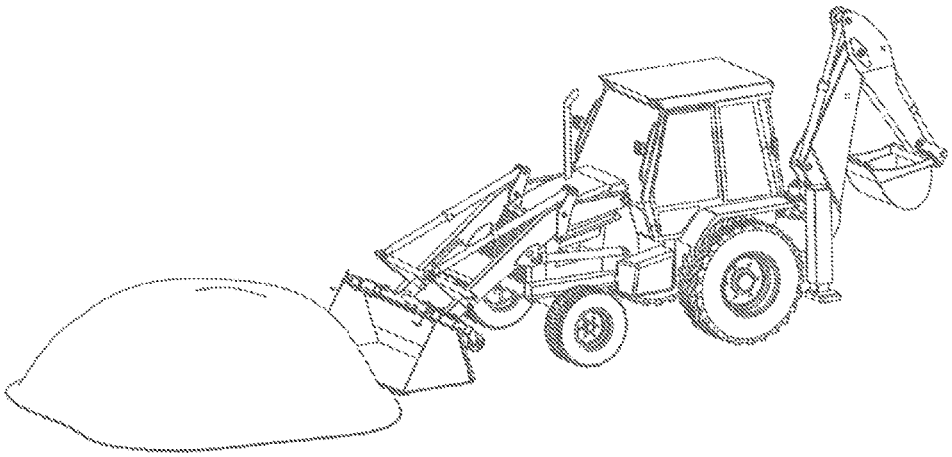

FIGS. 1 and 2 depict perspective diagrams of the loading of a bulk material into the bucket. These two figures show the step of loading the bulk material from two different viewpoints.

The loading can be various types of material:

all grades of gravel 0/20, 0/31.5, etc.

sand (stabilized), chippings, cement concrete (depending on the water content), asphalt concrete (coated), etc.

The bucket is used to load the bulk material from a heap. In another embodiment, the bucket is used to collect a bulk material under the dump gate of a truck.

Figure 3:
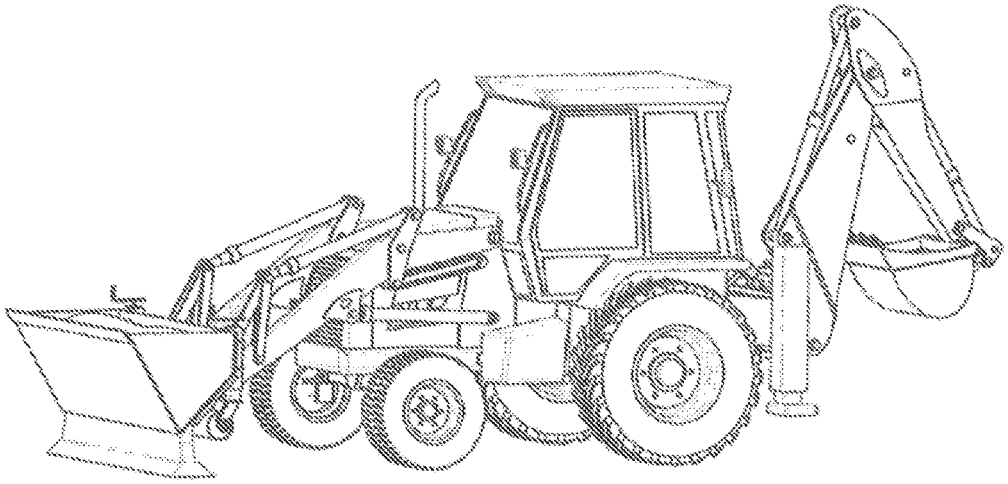
FIGS. 3 and 4 depict a diagram of the tipping of a bulk material out from the bucket that forms the subject of the present invention.
Figure 4:
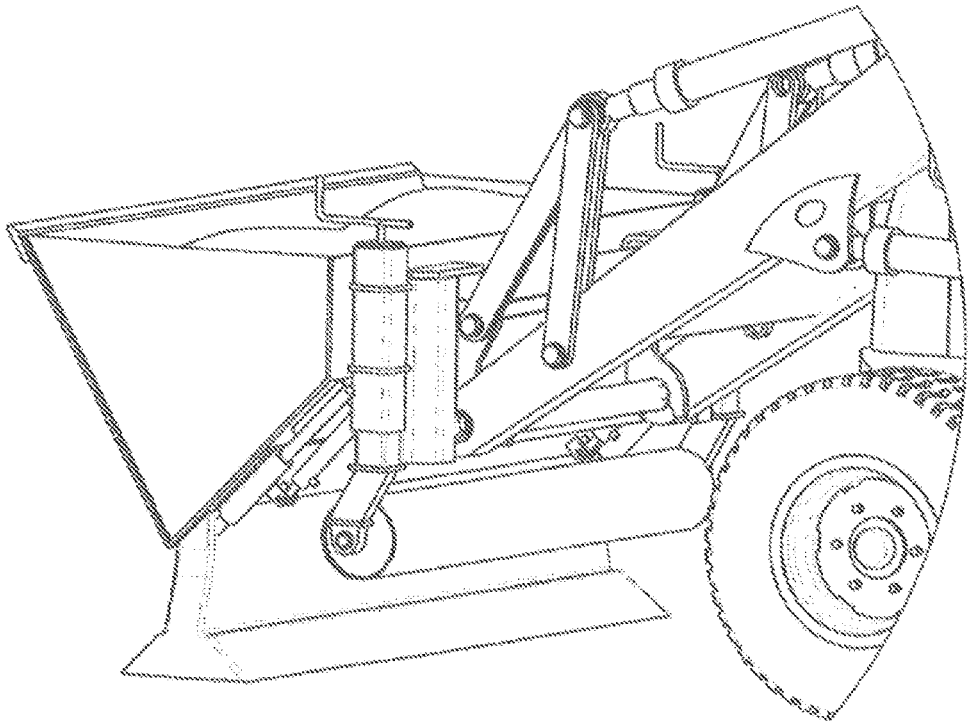

FIGS. 3 and 4 depict a diagram of the tipping of a bulk material out of the bucket. These two figures show a step in the tipping-out of the bulk material, from two different viewpoints.

In this case, the opening gate allows the bulk material to be released and to pour out.

Figure 5:
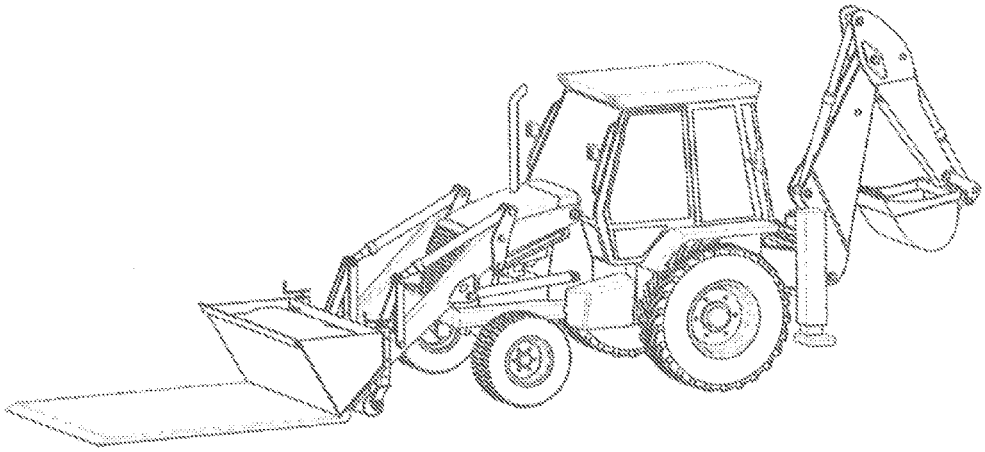
FIGS. 5 and 6 depict a diagram of the spreading of a bulk material using the bucket placed on the ground, which is the subject of the present invention.
Figure 6:
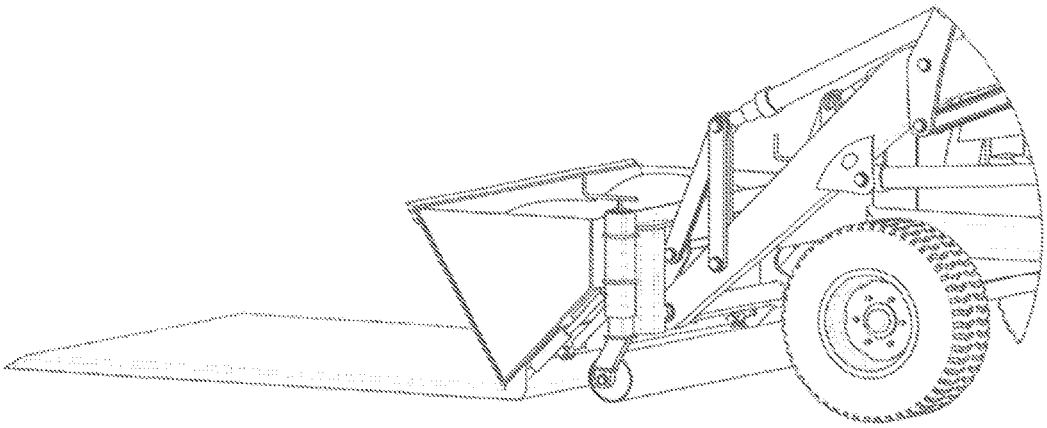

FIGS. 5 and 6 depict a diagram of the spreading of a bulk material using the bucket that forms the subject of the present invention. These two figures show a step of spreading the bulk material from two different viewpoints.

More particularly, FIG. 6 shows the roller adjusted in such a way that the bottom of the bucket is held a certain distance off the ground. In this way, the roller dictates the thickness of the bulk material. Adjusting this distance regulates the thickness of the layer of material distributed after the spreading phase.

The material leaves the bucket via the opening gate which releases the bulk material under the effect of gravity.

Figure 7:
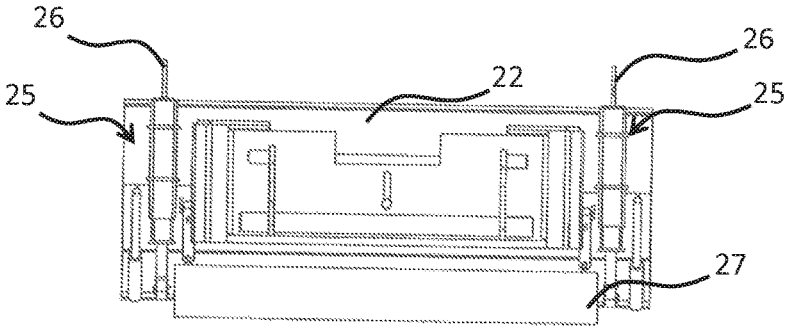
FIG. 7 depicts a rear view of the bucket according to one embodiment.

FIG. 7 depicts the bucket on which the cranks 26 are mounted. Shown here are the adjusting system 25, the roller 27 and the support panel 22.

Figure 8:
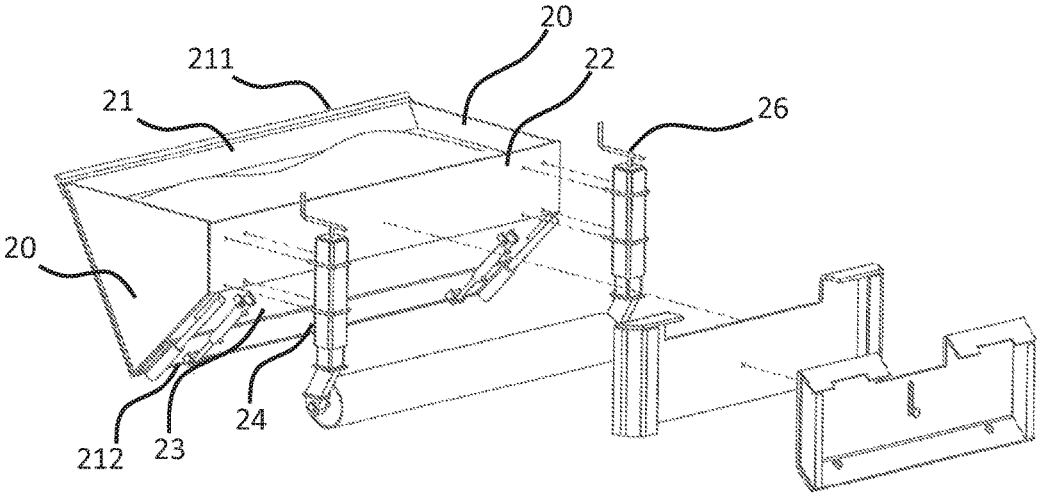
FIG. 8 depicts an exploded view of the bucket according to one embodiment.

FIG. 8 depicts an exploded view of a bucket. Shown here are two lateral panels 20 extending on each side of a loading panel 21, the support panel 22 to which the adjusting system 25 with the roller 27 and the cranks 26 is fixed. Also shown is the opening panel 23 comprising a gate 24.

The loading panel 21 has four edges, two edges connecting the lateral panels 20, a loading edge 211 delimiting part of the main opening of the bucket, an unloading edge 212 delimiting part of a secondary opening. The unloading edge is on the other side of the panel from the loading edge 211. The secondary opening is controlled by the opening of the gate 24 on the opening panel 23.

Figure 9:
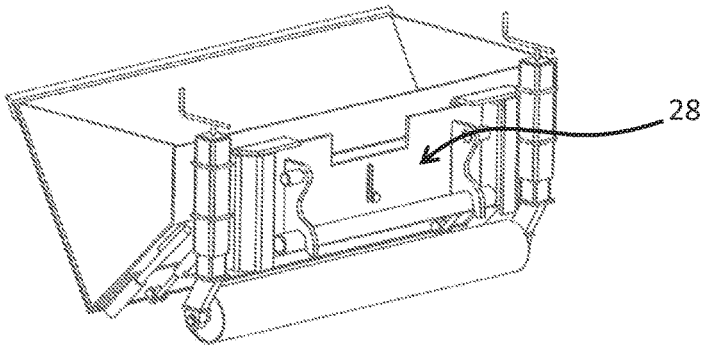
FIG. 9 depicts a perspective view of a bucket according to one embodiment.
Figure 10:
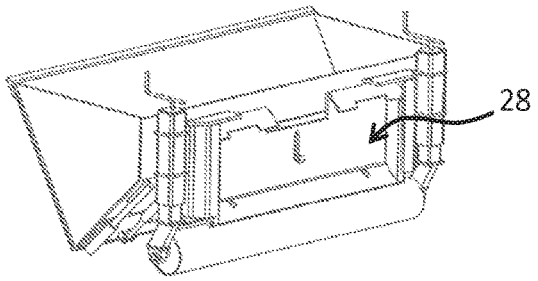
FIG. 10 depicts another perspective view of a bucket according to another embodiment.

FIGS. 9 and 10 depict two alternative forms of bucket with two different types of fixing attachment 28 for a type of vehicle. The two attachments both have the same functionalities but differ only in terms of the system for fixing to the vehicle. The attachment is produced in such a way that it fits the chosen vehicle while at the same time maintaining the rotation and translation so that the attachment is floating relative to the ground.

Figure 11:
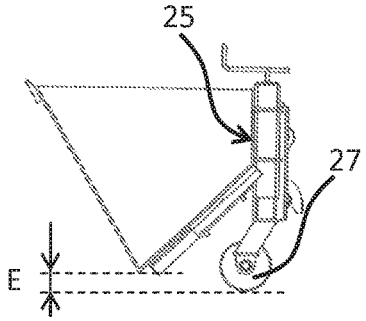
FIG. 11 depicts a side view of the bucket according to one embodiment.

FIG. 11 depicts a side view of the bucket. A roller connected to the adjusting system 25 can be seen. The roller 27 is made of steel and situated to the rear of the bucket. When the bucket is in the spreading position, the roller 27 rests on the ground.

The adjusting system 25 comprises two hand cranks (one on each side of the bucket), this is adjustable height-wise and thus makes it possible to choose the thickness E to be spread. The ground is depicted in dotted line and the difference between the bottom of the bucket and the ground is indicated by the reference E.

In one embodiment, the thickness differs from one side to the other.

The roller 27 has the advantage of having a bearing surface over the entire length of the bucket, thus avoiding under-thicknesses.

Figure 12:
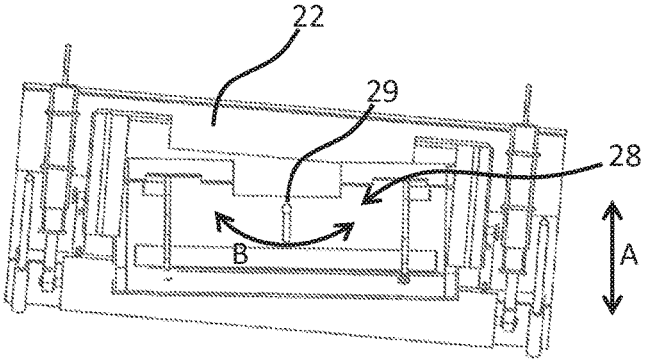
FIG. 12 depicts a rear view of the bucket to show the attachment according to one embodiment.

FIG. 12 depicts a rear view of the bucket. It shows a fixing attachment 28 on which the position of the fixing attachment 28 is over-inclined relative to the bucket. Specifically, the fixing attachment 28 has transverse mobility (arrow A) relative to the support panel 22.

The fixing attachment 28 also has the ability to move about an axis of rotation 29 relative to the ground (arrow B). The axis of rotation is perpendicular to the support panel 22.

Figure 13:
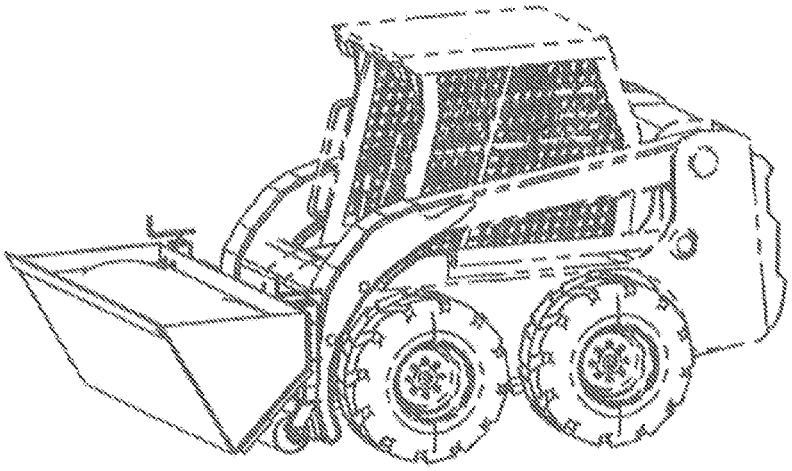
FIG. 13 depicts a perspective view of the bucket mounted on a vehicle according to one embodiment.

FIG. 13 depicts a perspective view of the bucket mounted on a vehicle according to one embodiment.

In an alternative form of embodiment, the mobile roller 27 is replaced by a caterpillar track system.

In one embodiment, the width of the bucket is 2 m. It is comprised between 1 and 3.5 m.

In another embodiment, the bucket comprises several opening gates making it possible to vary the spreading width.

In another embodiment, the opening gate comprises a guideway system to slide the gate from left to right, thus varying the spreading width.

The diameter of the roller is 20 cm. It is comprised between 10 and 50 cm.

In another alternative form which has not been depicted, the bucket comprises a plate positioned above the bucket leaving a width of opening that can be varied between 0.5 and 5 cm so that the chippings can be spread by inclining the bucket.

LIST OF PARTS

20 lateral panels
21 loading panel
211 loading edge
212 unloading edge

22 support panel
23 opening panel
24 gate
25 adjusting system
26 cranks
27 roller
28 fixing attachment for fixing to a vehicle
29 axis of rotation
E adjustable thickness
A translation arrow
B rotation arrow

The invention claimed is:

1. A bucket for an industrial vehicle configured to load, move, transport, tip and spread a bulk material, the bucket comprises:

two lateral panels extending on each side of a loading panel, said loading panel comprises a loading edge and an unloading edge;

a support panel to support an adjuster configured to adjust a thickness of a layer of bulk material to be spread on the ground, said support panel being situated on other side of the bucket from the loading panel;

an opening panel comprising a gate comprising an opening edge, the opening edge is adjacent to the unloading edge of the loading panel when the gate is in a closed position, the closed position of the gate is configured to hold back the bulk material, the opening edge moves away from the unloading edge of the loading panel to create an opening when the gate is in an open position and an opening, the opening allows the bulk material to pour out;

the adjuster comprises a rotationally moveable roller situated under the bucket and configured to turn in a rotational direction of wheels of the vehicle and to rest on the ground during a spreading operation; and a fixing attachment configured to be fixed to the vehicle, the fixing attachment being housed in a vertical translationally movable space configured to allow a vertical translational movement and the fixing attachment is configured to rotationally move about an axis of rotation perpendicular to the support panel so as to turn the bucket relative to the ground.

2. The bucket as claimed in claim 1, wherein a vertical travel of the fixing attachment is from 0.5 to 50 cm.

3. The bucket as claimed in claim 2, wherein the vertical travel of the fixing attachment is from 1 to 15 cm.

4. The bucket as claimed in claim 1, wherein the rotationally moveable roller is configured for a vertical translational movement relative to the ground so as to vary a height of the bucket relative to the ground.

5. The bucket as claimed in claim 1, wherein the gate is configured for a rectilinear translational movement supported on guideways on each side of the gate; and wherein a mobility of the gate is actuated by actuating cylinders.

6. The bucket as claimed in claim 1, wherein a length of the rotationally moveable roller is at least equal to half a length of the bucket.

7. The bucket as claimed in claim 1, further comprising a plurality of gates configured for a rectilinear translational movement.

8. The bucket as claimed in claim 1, further comprising a surface that reduces the opening created by the opening panel in the open position.

9. The bucket as claimed in claim 8, wherein a position of the surface relative to the opening is adjusted to translationally move the surface.

10. A vehicle equipped with a bucket as claimed in claim 1.

* * * * *